US011293297B2

(12) United States Patent
Korepin et al.

(10) Patent No.: US 11,293,297 B2
(45) Date of Patent: Apr. 5, 2022

(54) APPARATUS FOR CONTROLLING TURBINE BLADE TIP CLEARANCE AND GAS TURBINE INCLUDING THE SAME

(71) Applicant: DOOSAN HEAVY INDUSTRIES & CONSTRUCTION CO., LTD., Changwon-si (KR)

(72) Inventors: Oleksiy Korepin, Gimhae (KR); Jin Bong Ha, Gimhae (KR)

( * ) Notice: Subject to any disclaimer, the term of this patent is extended or adjusted under 35 U.S.C. 154(b) by 0 days.

(21) Appl. No.: 17/229,902

(22) Filed: Apr. 14, 2021

(65) Prior Publication Data

US 2021/0396146 A1 Dec. 23, 2021

(30) Foreign Application Priority Data

Jun. 23, 2020 (KR) ..... 10-2020-0076604

(51) Int. Cl.
*F01D 11/22* (2006.01)

(52) U.S. Cl.
CPC ..... *F01D 11/22* (2013.01); *F05D 2220/32* (2013.01); *F05D 2240/55* (2013.01)

(58) Field of Classification Search
CPC ..... F01D 11/22; F01D 11/20; F05D 2220/32; F05D 2240/55
See application file for complete search history.

(56) References Cited

U.S. PATENT DOCUMENTS 5,018,942 A * 5/1991 Ciokajlo ..... F01D 11/22 415/173.2

5,035,573 A * 7/1991 Tseng ..... F01D 11/22 415/173.2

(Continued)

FOREIGN PATENT DOCUMENTS

EP 2273073 A2 5/2010
JP 03168303 A 7/1991

(Continued)

OTHER PUBLICATIONS

KR OA dated Sep. 5, 2021.
EESR dated Oct. 11, 2011.

*Primary Examiner* — J. Todd Newton
*Assistant Examiner* — Theodore C Ribadeneyra
(74) *Attorney, Agent, or Firm* — Harvest IP Law, LLP

(57) ABSTRACT

An apparatus for controlling turbine blade tip clearance is provided. The apparatus for controlling turbine blade tip clearance includes a turbine casing configured to guide a flow of combustion gas, an actuator ring rotatably mounted outside the turbine casing, a plurality of turbine blades rotatably mounted inside the turbine casing, a plurality of ring segments surrounding tips of the turbine blades and installed to form a predetermined gap with each tip, a plurality of rotary shafts each configured to have one end connected to several of the plurality of ring segments and the other end extending radially from the turbine casing, a link member configured to rotate an associated one of the rotary shafts according to circumferential rotational motion of the actuator ring, and a pusher member provided at an inner end of the rotary shaft to move the ring segments radially inward by rotation of the rotary shaft, wherein the actuator ring rotates back and forth in a predetermined angular range by an actuator installed outside the turbine casing.

18 Claims, 8 Drawing Sheets

(56) References Cited

U.S. PATENT DOCUMENTS

| | | | | | |
|---|---|---|---|---|---|
| 5,054,997 | A * | 10/1991 | Corsmeier | F01D 11/22 | 415/173.2 |
| 5,096,375 | A * | 3/1992 | Ciokailo | F01D 11/22 | 415/127 |
| 5,203,673 | A | 4/1993 | Evans | | |
| 5,362,202 | A * | 11/1994 | Derouet | F01D 11/22 | 415/148 |
| 8,177,490 | B2 * | 5/2012 | Bouru | F04D 29/563 | 415/160 |
| 8,240,986 | B1 * | 8/2012 | Ebert | F01D 11/025 | 415/173.2 |
| 8,534,996 | B1 | 9/2013 | Pankey | | |
| 9,028,205 | B2 * | 5/2015 | Harris | F01D 17/143 | 415/173.1 |
| 9,598,975 | B2 * | 3/2017 | Uskert | F01D 11/24 | |
| 10,280,782 | B2 | 5/2019 | McCaffrey | | |
| 10,612,408 | B2 | 4/2020 | Borja | | |
| 11,015,613 | B2 * | 5/2021 | Kerns | F01D 11/08 | |
| 2002/0071763 | A1 | 6/2002 | Brandl | | |
| 2002/0150469 | A1 * | 10/2002 | Bolms | F01D 11/22 | 415/115 |
| 2012/0063884 | A1 * | 3/2012 | Klingels | F01D 11/22 | 415/1 |
| 2014/0212262 | A1 * | 7/2014 | Harris | F01D 11/22 | 415/1 |
| 2015/0218959 | A1 | 8/2015 | Barb | | |
| 2016/0047266 | A1 * | 2/2016 | Powell | F01D 11/22 | 415/1 |
| 2016/0177768 | A1 * | 6/2016 | Borja | F01D 25/24 | 415/134 |
| 2016/0333721 | A1 | 11/2016 | McCaffrey | | |
| 2016/0356168 | A1 * | 12/2016 | Duguay | F01D 11/22 | |
| 2016/0356169 | A1 * | 12/2016 | Duguay | F01D 11/20 | |
| 2020/0025019 | A1 | 1/2020 | Feulner | | |

FOREIGN PATENT DOCUMENTS

| | | | |
|---|---|---|---|
| JP | 4383060 | B2 | 12/2009 |
| JP | 4387697 | B2 | 12/2009 |
| JP | 5844068 | B2 | 1/2016 |
| JP | 6403883 | B2 | 10/2018 |
| KR | 20190057546 | A | 5/2019 |
| KR | 101957590 | B1 | 6/2019 |

* cited by examiner

APPARATUS FOR CONTROLLING TURBINE BLADE TIP CLEARANCE AND GAS TURBINE INCLUDING THE SAME

CROSS-REFERENCE TO RELATED APPLICATION

This application claims priority to Korean Patent Application No. 10-2020-0076604, filed on Jun. 23, 2020, the disclosure of which is incorporated herein by reference in its entirety.

BACKGROUND

Technical Field

Apparatuses and methods consistent with exemplary embodiments relate to an apparatus for controlling turbine blade tip clearance and a gas turbine including the same.

Description of the Related Art

Turbines are machines that obtain a rotational force by impingement or reaction force using a flow of a compressible fluid such as steam or gas, and include a steam turbine using steam, a gas turbine using hot combustion gas, and so on.

The gas turbine includes a compressor, a combustor, and turbine. The compressor has an air inlet for introduction of air thereinto, and includes a plurality of compressor vanes and a plurality of compressor blades alternately arranged in a compressor casing.

The combustor supplies fuel to air compressed by the compressor and ignites a mixture thereof with a burner to produce high-temperature and high-pressure combustion gas.

The turbine includes a plurality of turbine vanes and a plurality of turbine blades alternately arranged in a turbine casing. In addition, a rotor is disposed to pass through centers of the compressor, the combustor, the turbine, and an exhaust chamber.

The rotor is rotatably supported at both ends thereof by bearings. The rotor has a plurality of disks fixed thereto, and a plurality of blades are connected to each of the disks while a drive shaft of a generator is connected to an end of the exhaust chamber.

The gas turbine is advantageous in that consumption of lubricant is extremely low due to an absence of mutual friction parts such as a piston-cylinder because the gas turbine does not have a reciprocating mechanism such as a piston in a four-stroke engine. Therefore, an amplitude, which is a characteristic of reciprocating machines, is greatly reduced, and the gas turbine has an advantage of high-speed motion.

The operation of the gas turbine is briefly described. That is, the air compressed by the compressor is mixed with fuel for combustion to produce high-temperature and high-pressure combustion gas which is injected into the turbine, and the injected combustion gas generates a rotational force while passing through the turbine vanes and turbine blades, thereby rotating the rotor.

In this case, a gap defined as a tip clearance is formed between the turbine casing and each of the plurality of blades. If the tip clearance is increased above an acceptable level, an amount of combustion gas that is not activated and is discharged between the turbine casing and the blade, reducing an overall efficiency of the gas turbine. In contrast, if the tip clearance decreases below an appropriate level, the blade may scratch the inner wall of the turbine casing. Therefore, adjusting the tip clearance of the turbine to an appropriate level is closely related to improving the performance of the gas turbine.

SUMMARY

Aspects of one or more exemplary embodiments provide an apparatus for controlling turbine blade tip clearance capable of uniformly controlling tip clearances of a plurality of turbine blades by rotating an actuator ring installed outside a turbine casing to move a plurality of ring segments circumferentially arranged inside the turbine casing all at once, and a gas turbine including the same.

Additional aspects will be set forth in part in the description which follows and, in part, will become apparent from the description, or may be learned by practice of the exemplary embodiments.

According to an aspect of an exemplary embodiment, there is provided an apparatus for controlling turbine blade tip clearance, the apparatus including: a turbine casing configured to guide a flow of combustion gas, an actuator ring rotatably mounted outside the turbine casing, a plurality of turbine blades rotatably mounted inside the turbine casing, a plurality of ring segments surrounding tips of the turbine blades and installed to form a predetermined gap with each tip, a plurality of rotary shafts each configured to have one end connected to several of the plurality of ring segments and the other end extending radially from the turbine casing, a link member configured to rotate an associated one of the rotary shafts according to circumferential rotational motion of the actuator ring, and a pusher member provided at an inner end of the rotary shaft to move the several ring segments radially inward by rotation of the rotary shaft. The actuator ring may rotate back and forth in a predetermined angular range by an actuator installed outside the turbine casing.

The link member may be connected between the actuator ring and an outer end of the rotary shaft to be eccentric in the rotary shaft and the actuator ring.

The apparatus may further include an eccentric member coupled to the outer end of the rotary shaft to rotate together with the rotary shaft, the eccentric member extending in a direction perpendicular to the rotary shaft so that the link member is rotatably connected to an end of the eccentric member.

The apparatus may further include a bearing bracket mounted outside the plurality of ring segments and installed such that the pusher member passes through the bearing bracket, and a screw bush mounted in a center of the bearing bracket such that the pusher member passes through the screw bush and configured to move the pusher member radially when the pusher member rotates.

A lower end of the rotary shaft may be inserted into an upper portion of the pusher member, and the pusher member may move axially with respect to the rotary shaft and rotate together with the rotary shaft so as not to rotate about the rotary shaft.

The screw bush may include a screw cam formed on a lower surface around a central through-hole thereof, and the pusher member may include a screw rib slidably coupled to the screw cam on an outer peripheral surface thereof.

The apparatus may further include a pair of elastic restoration devices mounted between both sides of the bearing bracket and the ring segments and configured to restore force during contraction to pull the ring segments radially outward to maintain the gap above a predetermined value.

Each of the elastic restoration devices may include a mounting shaft having one end coupled to an associated one of the ring segments and the other end coupled to the bearing bracket, a spring mounting member fixed to the bearing bracket by a coupling member and having a through-hole through which the mounting shaft passes, and a spring having one end coupled to the ring segment and the other end coupled to the spring mounting member, the spring being disposed around the mounting shaft.

The apparatus may further include a plurality of roller bearings mounted on an outer peripheral surface of the turbine casing to support an inner peripheral surface of the actuator ring.

The plurality of ring segments may be configured such that four to six ring segments are mounted on each of eight segment members arranged circumferentially, and the pusher member may be coupled to each of the segment members. The apparatus may further include a seal plate mounted between circumferential sides of two adjacent segment members of the eight segment members to prevent leakage of gas therebetween, and a positioning pin mounted across the circumferential sides of the two segment members to allow the two segment members to move radially at the same time.

According to an aspect of another exemplary embodiment, there is provided a gas turbine including: a compressor configured to compresses outside air, a combustor configured to mix fuel with the air compressed by the compressor to burn a mixture thereof, a turbine comprising a plurality of turbine blades in a turbine casing rotated by combustion gas discharged from the combustor to generate power, and an apparatus for controlling tip clearance between the turbine casing and the turbine blades. The apparatus for controlling tip clearance may include the turbine casing configured to guide a flow of combustion gas, an actuator ring rotatably mounted outside the turbine casing, the plurality of turbine blades rotatably mounted inside the turbine casing, a plurality of ring segments surrounding tips of the turbine blades and installed to form a predetermined gap with each tip, a plurality of rotary shafts each configured to have one end connected to several of the plurality of ring segments and the other end extending radially from the turbine casing, a link member configured to rotate an associated one of the rotary shafts according to circumferential rotational motion of the actuator ring, and a pusher member provided at an inner end of the rotary shaft to move the several ring segments radially inward by rotation of the rotary shaft. The actuator ring may rotate back and forth in a predetermined angular range by an actuator installed outside the turbine casing.

The link member may be connected between the actuator ring and an outer end of the rotary shaft to be eccentric in the rotary shaft and the actuator ring.

The gas turbine may further include an eccentric member coupled to the outer end of the rotary shaft to rotate together with the rotary shaft, the eccentric member extending in a direction perpendicular to the rotary shaft so that the link member is rotatably connected to an end of the eccentric member.

The gas turbine may further include a bearing bracket mounted outside the plurality of ring segments and installed such that the pusher member passes through the bearing bracket, and a screw bush mounted in a center of the bearing bracket such that the pusher member passes through the screw bush and configured to move the pusher member radially when the pusher member rotates.

A lower end of the rotary shaft may be inserted into an upper portion of the pusher member, and the pusher member may move axially with respect to the rotary shaft and rotate together with the rotary shaft so as not to rotate about the rotary shaft.

The screw bush may include a screw cam formed on a lower surface around a central through-hole thereof, and the pusher member may include a screw rib slidably coupled to the screw cam on an outer peripheral surface thereof.

The gas turbine may further include a pair of elastic restoration devices mounted between both sides of the bearing bracket and the ring segments and configured to restore force during contraction to pull the ring segments radially outward to maintain the gap above a predetermined value.

Each of the elastic restoration devices may include a mounting shaft having one end coupled to an associated one of the ring segments and the other end coupled to the bearing bracket, a spring mounting member fixed to the bearing bracket by a coupling member and having a through-hole through which the mounting shaft passes, and a spring having one end coupled to the ring segment and the other end coupled to the spring mounting member, the spring being disposed around the mounting shaft.

The gas turbine may further include a plurality of roller bearings mounted on an outer peripheral surface of the turbine casing to support an inner peripheral surface of the actuator ring.

The plurality of ring segments may be configured such that four to six ring segments are mounted on each of eight segment members arranged circumferentially, and the pusher member may be coupled to each of the segment members. The apparatus may further include a seal plate mounted between circumferential sides of two adjacent segment members of the eight segment members to prevent leakage of gas therebetween, and a positioning pin mounted across the circumferential sides of the two segment members to allow the two segment members to move radially at the same time.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
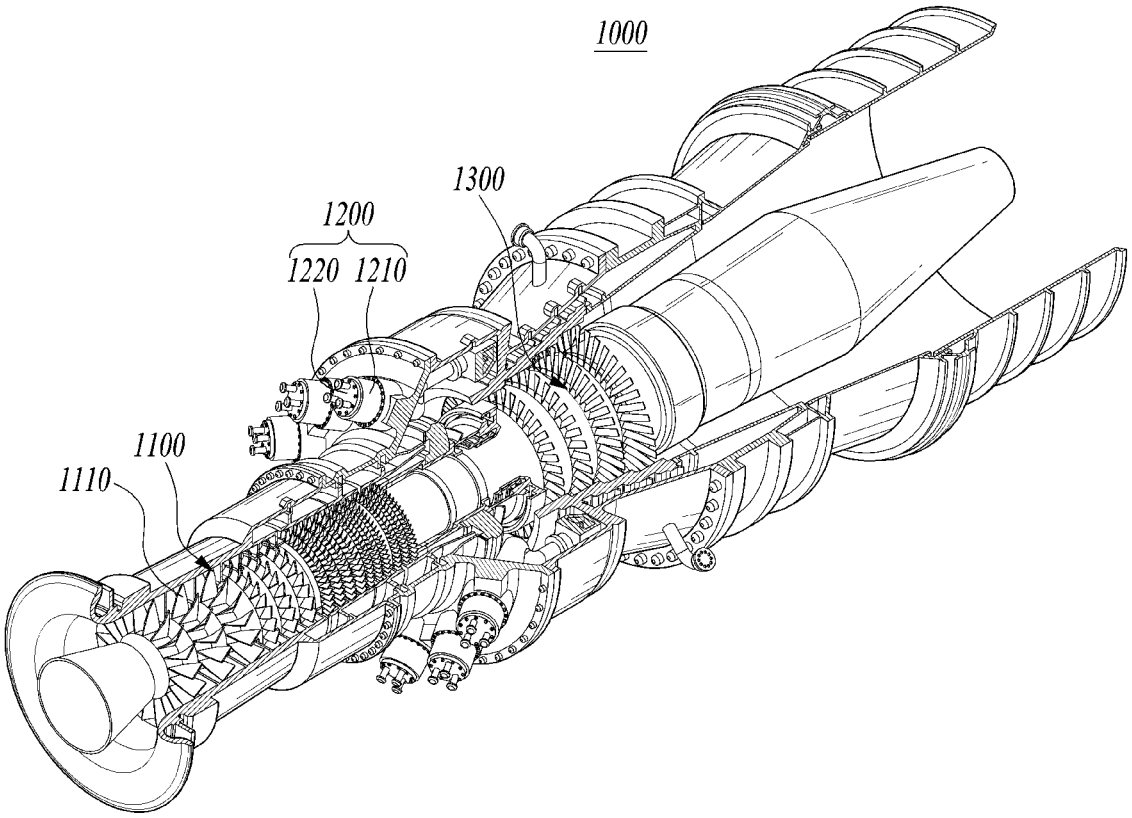
FIG. 1 is a partial cutaway perspective view illustrating a gas turbine according to an exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Further, terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, the components associated with such an ordinal number should not be limited in the order of use, placement order, or the like. If necessary, each ordinal number may be used interchangeably.

Hereinafter, a tip clearance control apparatus and a gas turbine including the same according to exemplary embodiments will be described with reference to the accompanying drawings. It should be noted that like reference numerals refer to like parts throughout the specification. In certain exemplary embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

Figure 2:
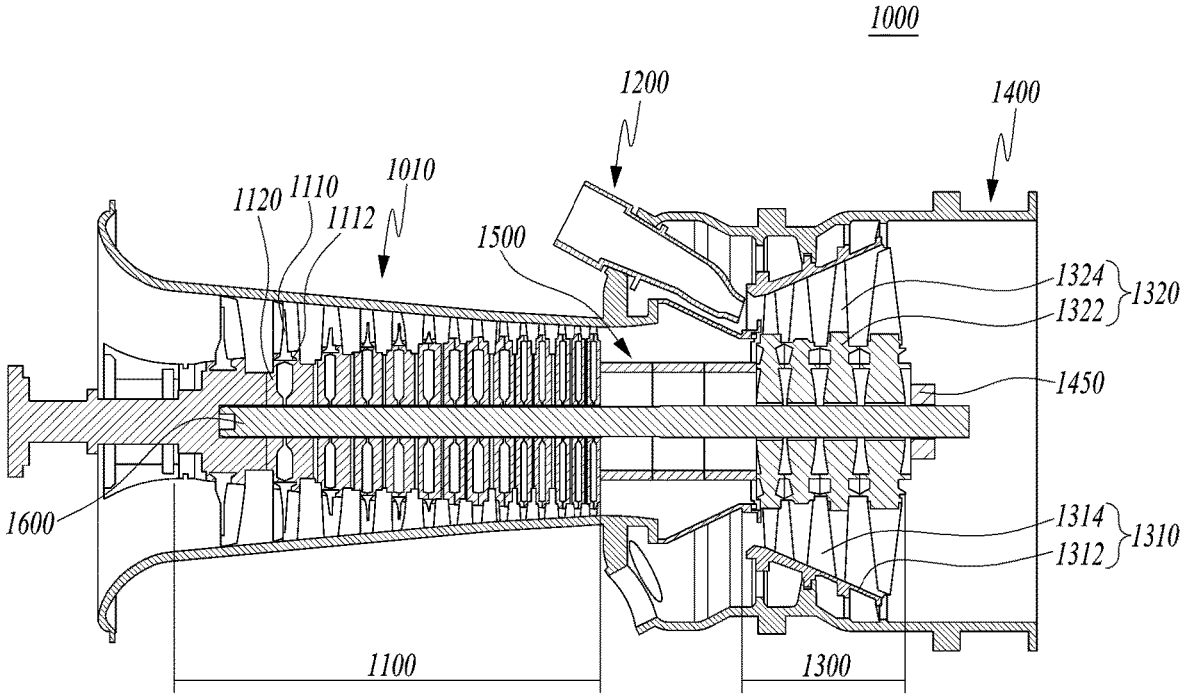
FIG. 2 is a cross-sectional view illustrating a schematic structure of the gas turbine according to the exemplary embodiment.
Figure 3:
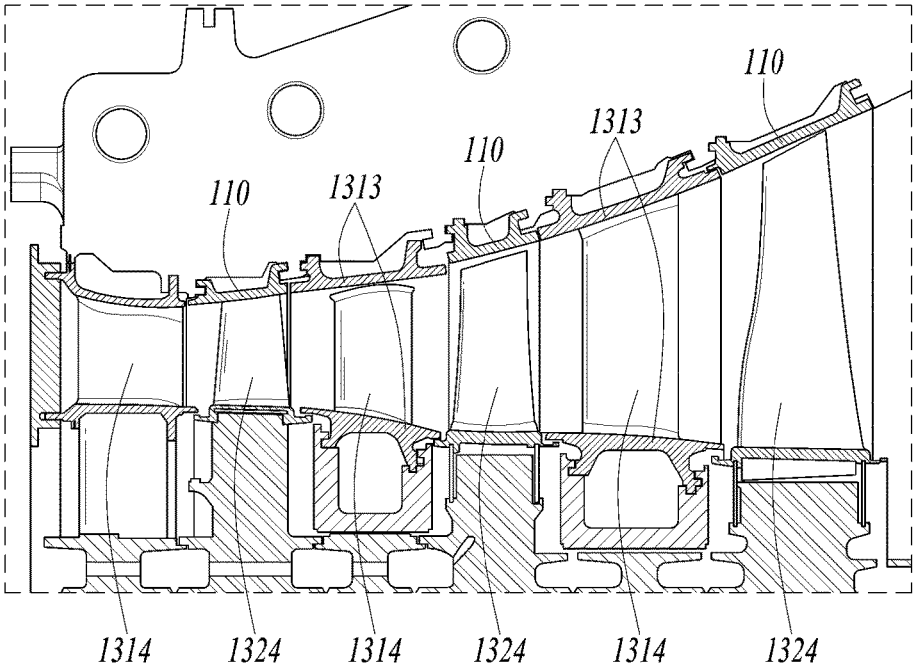
FIG. 3 is a partial cross-sectional view illustrating an internal structure of the gas turbine according to the exemplary embodiment.

FIG. 1 is a partial cutaway perspective view illustrating a gas turbine according to an exemplary embodiment. FIG. 2 is a cross-sectional view illustrating a schematic structure of the gas turbine according to the exemplary embodiment. FIG. 3 is a partial cross-sectional view illustrating an internal structure of the gas turbine according to the exemplary embodiment.

Referring to FIG. 1, the gas turbine 1000 according to the exemplary embodiment includes a compressor 1100, a combustor 1200, and a turbine 1300. The compressor 1100 including a plurality of blades 1110 arranged radially rotates the blades 1110, and air is compressed by rotation of the blades 1110 and flows. A size and installation angle of each of the blades 1110 may vary depending on an installation position thereof. The compressor 1100 may be directly or indirectly connected to the turbine 1300, to receive some of the power generated by the turbine 1300 and use the received power to rotate the blades 1110.

The air compressed by the compressor 1100 flows to the combustor 1200. The combustor 1200 includes a plurality of combustion chambers 1210 and fuel nozzle modules 1220 arranged annularly.

Referring to FIG. 2, the gas turbine 1000 according to the exemplary embodiment includes a housing 1010 and a diffuser 1400 disposed behind the housing 1010 to discharge the combustion gas passing through the turbine 1300. The combustor 1200 is disposed in front of the diffuser 1400 to combust the compressed air supplied thereto.

Based on a direction of an air flow, the compressor 1100 is disposed at an upstream side, and the turbine 1300 is disposed at a downstream side. A torque tube 1500 serving as a torque transmission member for transmitting the rotational torque generated in the turbine 1300 to the compressor 1100 is disposed between the compressor 1100 and the turbine 1300.

The compressor 1100 includes a plurality of compressor rotor disks 1120 each of which is fastened by a tie rod 1600 to prevent axial separation in an axial direction of the tie rod 1600.

For example, the compressor rotor disks 1120 are axially aligned in a state in which the tie rod 1600 forming a rotary shaft passes through the centers of the compressor rotor disks 1120. Here, adjacent compressor rotor disks 1120 are arranged so that facing surfaces thereof are in tight contact with each other by being pressed by the tie rod 1600. The adjacent compressor rotor disks 1120 cannot rotate because of this arrangement.

Each of the compressor rotor disks 1120 has a plurality of blades 1110 radially coupled to an outer peripheral surface thereof. Each of the blades 1110 has a dovetail 1112 fastened to the compressor rotor disk 1120.

A plurality of vanes are fixedly arranged between each of the compressor rotor disks 1120 in the housing 1010. While the compressor rotor disks 1120 rotate along with a rotation of the tie rod 1600, the vanes fixed to the housing 1010 do not rotate. The vanes guide the flow of the compressed air moved from front-stage blades 1110 to rear-stage blades 1100.

The dovetail 1112 may be fastened by a tangential type or an axial type, which may be selected according to a structure of a gas turbine. The dovetail 1112 may have a dovetail shape or a fir-tree shape. In some cases, the blades 1100 may be fastened to the compressor rotor disks 1120 by using other types of fastening member such as a key or a bolt.

The tie rod 1600 is disposed to pass through centers of the plurality of compressor rotor disks 1120 and turbine rotor disks 1322. The tie rod 1600 may be a single tie rod or a plurality of tie rods. One end of the tie rod 1600 is fastened to a most upstream compressor rotor disk, and the other end thereof is fastened by a fixing nut 1450.

It is understood that the type of the tie rod 1600 may not be limited to the example illustrated in FIG. 2, and may be changed or vary according to one or more other exemplary embodiments. For example, a single tie rod may be disposed to pass through the centers of the rotor disks, a plurality of tie rods may be arranged circumferentially, or a combination thereof may be used.

Also, in order to increase the pressure of fluid and adjust an actual inflow angle of the fluid, entering into an inlet of the combustor, a deswirler serving as a guide vane may be installed at the rear stage of the diffuser of the compressor 1100 so that the actual inflow angle matches a designed inflow angle.

The combustor 1200 mixes fuel with the introduced compressed air, burns a fuel-air mixture to produce high-temperature and high-pressure combustion gas with high energy, and increases the temperature of the combustion gas to a temperature at which the combustor and the turbine components are able to be resistant to heat through an isobaric combustion process.

A plurality of combustors constituting the combustor 1200 may be arranged in the housing in a form of a cell. Each of the combustors may include a burner having a fuel injection nozzle and the like, a combustor liner defining a combustion chamber, and a transition piece serving as a connection between the combustor and the turbine.

The combustor liner provides a combustion space in which the fuel injected by the fuel injection nozzle is mixed with the compressed air supplied from the compressor. The combustor liner may include a flame container providing the combustion space in which the mixture of air and fuel is burned, and a flow sleeve defining an annular space while surrounding the flame container. The fuel injection nozzle is coupled to a front end of the combustor liner, and an ignition plug is coupled to a side wall of the combustor liner.

The transition piece is connected to a rear end of the combustor liner to transfer the combustion gas toward the turbine. An outer wall of the transition piece is cooled by the compressed air supplied from the compressor to prevent the transition piece from being damaged due to the high temperature of the combustion gas.

To this end, the transition piece has cooling holes through which the compressed air is injected, and the compressed air cools the inside of the transition piece and then flows toward the combustor liner.

The compressed air that has cooled the transition piece may flow in an annular space of the combustor liner, and may be supplied as a cooling air through the cooling holes, formed in the flow sleeve, from the outside of the flow sleeve to an outer wall of the combustor liner.

The high-temperature and high-pressure combustion gas ejected from the combustor 1200 is supplied to the turbine 1300. The supplied high-temperature and high-pressure combustion gas expands and applies impingement or reaction force to the turbine blades to generate rotational torque. A portion of the obtained rotational torque is transmitted via the torque tube to the compressor, and the remaining portion which is the excessive torque is used to drive a generator or the like.

The turbine 1300 basically has a structure similar to the compressor 1100. That is, the turbine 1300 includes a turbine rotor 1320 similar to the rotor of the compressor 1100. The turbine rotor 1320 includes a plurality of turbine rotor disks 1322 and a plurality of turbine blades 1324 arranged radially. The turbine blades 1324 may be coupled to the turbine rotor disk 1322 in a dovetail coupling manner or the like.

In addition, a plurality of turbine vanes 1314 fixed to a turbine casing 1312 are provided between the turbine blades 1324 of the turbine rotor disk 1322 to guide a flow direction of the combustion gas passing through the turbine blades 1324. In this case, the turbine casing 1312 and the turbine vanes 1314 corresponding to a fixing body may be collectively referred to as a turbine stator 1310 in order to distinguish them from the turbine rotor 1320 corresponding to a rotating body.

Referring to FIG. 3, the turbine vanes 1314 are fixedly mounted to the turbine casing 1312 by a vane carrier 1313, which is an endwall coupled to inner and outer ends of each of the turbine vanes 1314. On the other hand, a ring segment 110 is mounted to the inner surface of the turbine casing at a position facing the outer end of each of the turbine blades 1324, with a predetermined gap. That is, the gap formed between the ring segment 110 and the outer end of the turbine blade 1324 is defined as a tip clearance.

Figure 4:
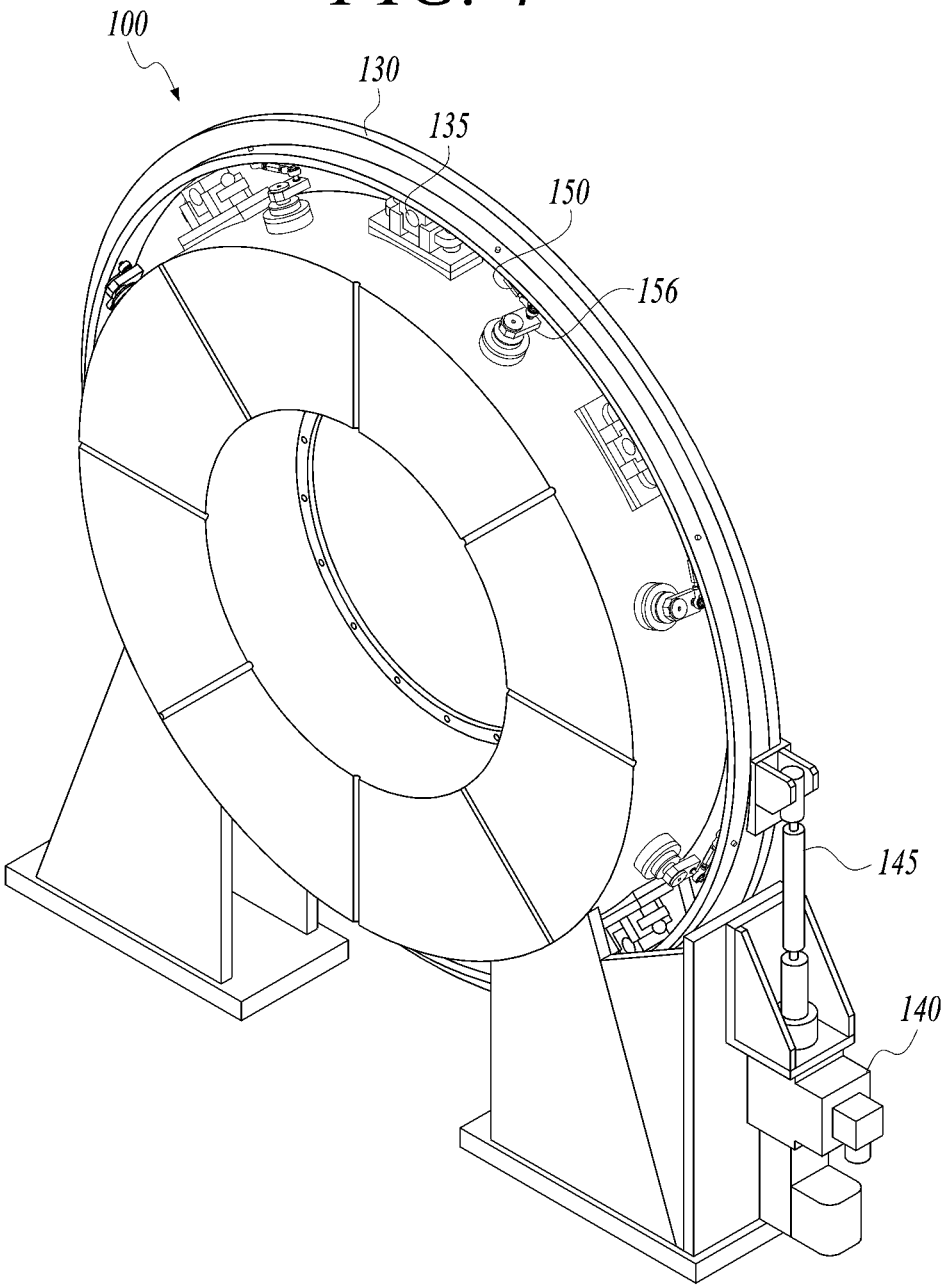
FIG. 4 is a perspective view illustrating an appearance of an apparatus for controlling turbine blade tip clearance according to an exemplary embodiment.
Figure 5:
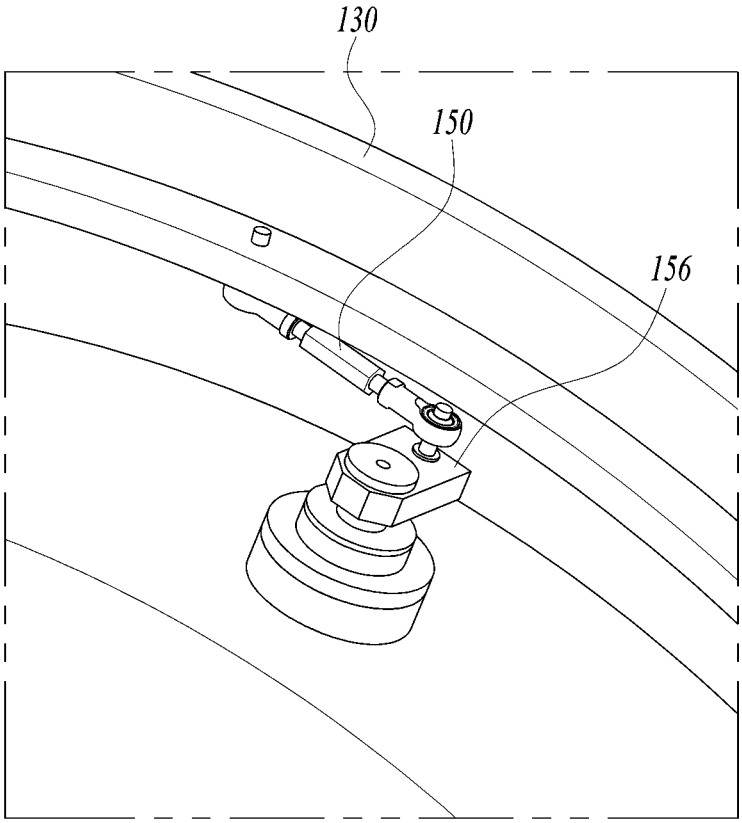
FIG. 5 is an enlarged perspective view illustrating surroundings of one link member in FIG. 4.
Figure 6:
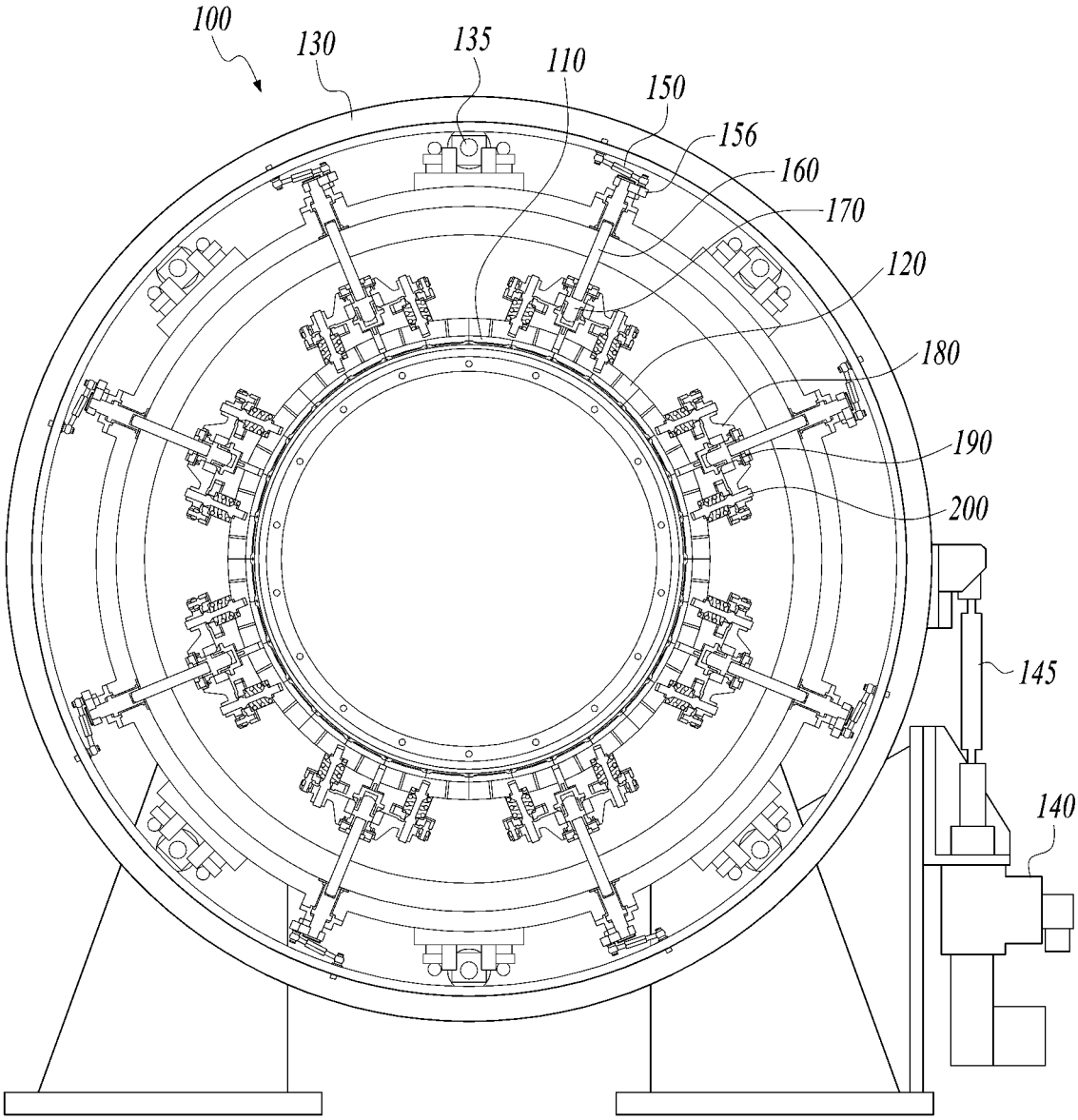
FIG. 6 is a cross-sectional view taken along a plane passing through a plurality of rotary shafts in FIG. 4.
Figure 7:
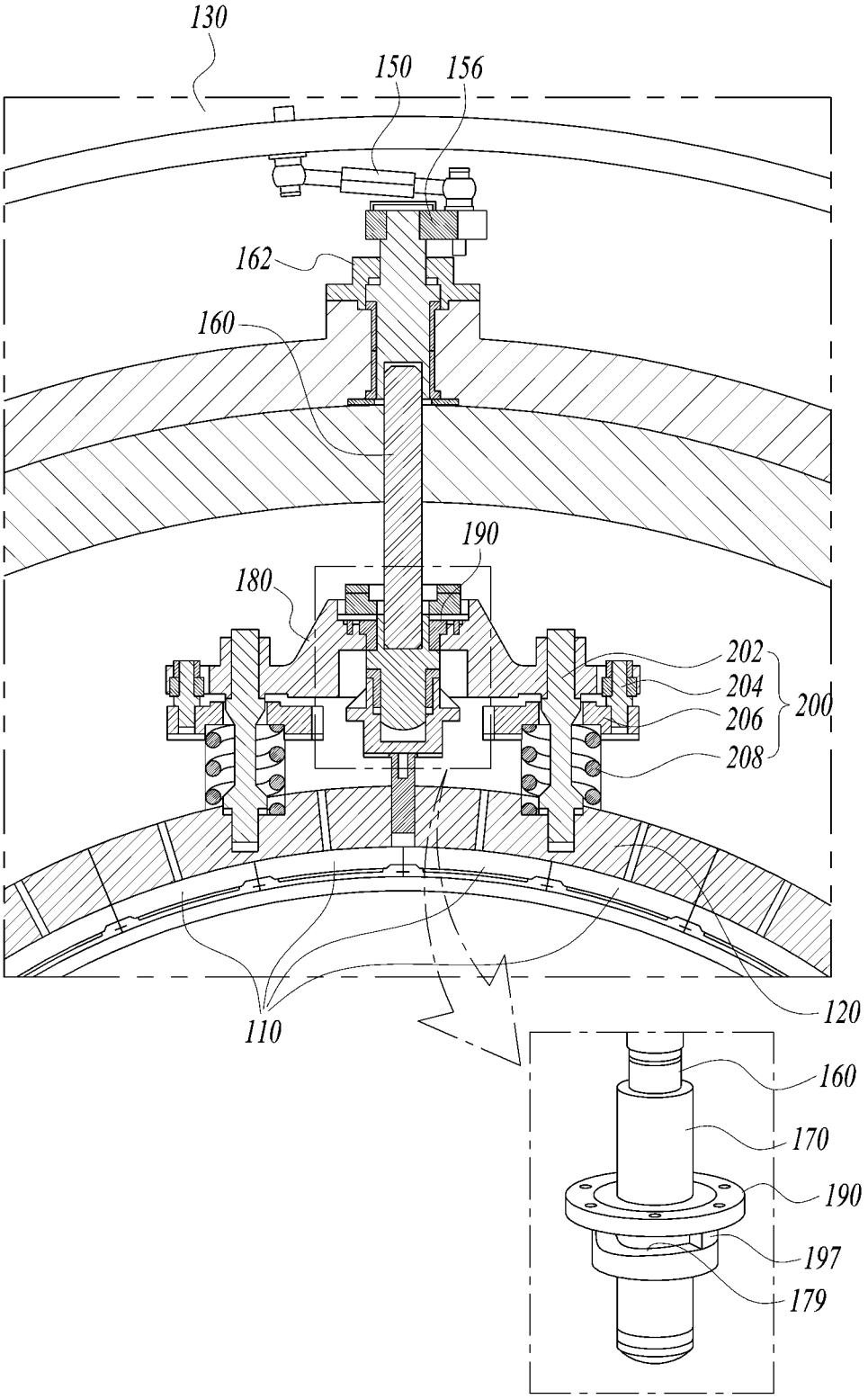
FIG. 7 is an enlarged perspective view illustrating surroundings from any link member to a plurality of ring segments in FIG. 6.

FIG. 4 is a perspective view illustrating an appearance of an apparatus for controlling turbine blade tip clearance according to an exemplary embodiment. FIG. 5 is an enlarged perspective view illustrating surroundings of one link member in FIG. 4. FIG. 6 is a cross-sectional view taken along a plane passing through a plurality of rotary shafts in FIG. 4. FIG. 7 is an enlarged perspective view illustrating surroundings from any link member to a plurality of ring segments in FIG. 6.

Referring to FIGS. 4 and 6, an apparatus for controlling turbine blade tip clearance 100 according to the exemplary embodiment includes a turbine casing adapted to guide a flow of combustion gas, an actuator ring 130 rotatably mounted outside the turbine casing, a plurality of turbine blades 1324 rotatably mounted inside the turbine casing, a plurality of ring segments 110 surrounding tips of the turbine blades and installed to form a predetermined gap with each tip, a plurality of rotary shafts 160 each configured to have one end connected to several of the plurality of ring segments 110 and the other end extending radially out of the turbine casing, a link member 150 configured to rotate an associated one of the rotary shafts 160 according to a circumferential rotational motion of the actuator ring 130, and a pusher member 170 provided at the inner end of the rotary shaft 160 to move the plurality of ring segments 110 radially inward by rotation of the rotary shaft.

In FIG. 4 which schematically illustrates a turbine casing surrounding a set of ring segments 110, the turbine casing may be a part of an outer casing of the constituent turbine casing 1312 of the turbine 1300 in FIG. 2. The turbine casing may be coupled to and supported by a pair of support brackets.

The actuator ring 130 may be rotatably mounted outside the turbine casing. The actuator ring 130 may be supported by a plurality of roller bearings 135 mounted on an outer peripheral surface of the turbine casing to support an inner peripheral surface of the actuator ring 130. The inner peripheral surface of the actuator ring 130 may be formed with grooves in which some rollers of the roller bearings 135 are inserted and supported. As illustrated in FIG. 6, the plurality of roller bearings 135 may include three roller bearings disposed on an upper half of the turbine casing and three roller bearings disposed on a lower half of the turbine casing at predetermined intervals.

Referring to FIGS. 6 and 7, the plurality of ring segments 110 may be configured such that several thereof are mounted on one segment member 120. For example, eight segment members 120 may be circumferentially installed, and 4 to 6 ring segments 110 may be mounted on each of the segment members 120.

Each of the plurality of rotary shafts 160 may have one end connected to the several ring segments 110 and the other end extending radially from the turbine casing. For example, the outer end of the rotary shaft 160 may be connected to the actuator ring 130 through the link member 150, the inner end of the rotary shaft 160 may be coupled to the pusher member 170, and the pusher member 170 may be coupled to each of the segment members 120 and connected to the several ring segments 110 coupled to the segment member 120.

As illustrated in FIG. 5, the link member 150 may be rotatably connected between the actuator ring 130 and the rotary shaft 160 to rotate the rotary shaft 160 according to the circumferential rotational motion of the actuator ring 130.

As illustrated in FIG. 7, the pusher member 170 may be provided at the inner end of the rotary shaft 160 to move the ring segments 110 radially inward by the rotation of the rotary shaft 160. When the ring segments 110 are moved radially inward, it is possible to reduce the turbine blade tip clearance.

As illustrated in FIG. 4, the actuator ring 130 may be rotated back and forth in a predetermined angular range by an actuator 140 installed outside the turbine casing. The actuator 140 may be mounted on a bracket fixed to one of a pair of support brackets that support the turbine casing. The actuator 140 may cause an actuator rod 145 to linearly reciprocate by an electric or hydraulic motor. The actuator rod 145 may have one end rotatably connected to the actuator 140 and the other end rotatably connected to the actuator ring 130. Thus, when the actuator 140 operates, the actuator rod 145 pushes one end of the actuator ring 130 to rotate the actuator ring 130 by a predetermined angle.

As illustrated in FIG. 5, the link member 150 may be connected between the actuator ring 130 and the outer end of each of the plurality of rotary shafts 160 to be eccentric in the rotary shaft 160 and the actuator ring 130. To this end, an eccentric member 156 may be coupled to the outer end of the rotary shaft 160 to rotate together with the rotary shaft 160. The eccentric member 156 may also extend in a direction perpendicular to the rotary shaft 160 so that the link member 150 is rotatably connected to the end of the eccentric member 156.

One end of the eccentric member 156 may be coupled to the outer end of the rotary shaft 160 such that the eccentric member 156 does not rotate. Thus, when the eccentric member 156 is rotated by the link member 150, the rotary shaft 160 coupled to the eccentric member 156 may rotate.

As illustrated in FIG. 7, the rotary shaft 160 is not entirely formed as a single member, but may be formed in a form in which separate upper and lower parts are combined with each other. Thus, the eccentric member 156 may be coupled to the top of the upper part of the rotary shaft 160, and the upper part of the rotary shaft 160 may be rotatably mounted to a bearing cover 162 coupled to an outer radial direction of the turbine casing.

The pusher member 170 may be formed as a single member, but may be formed of a connecting member, which is another component coupled to the outer peripheral surface of the radially inner end of the pusher member 170, and a coupling member coupled to the radially inner side of the connecting member. Thus, the inner end of the coupling member of the pusher member 170 may be coupled to the segment member 120.

Referring to FIGS. 6 and 7, the apparatus according to the exemplary embodiment may further include a bearing bracket 180 mounted outside the ring segments 110 and installed such that the pusher member 170 passes through the bearing bracket 180, and a screw bush 190 mounted in the center of the bearing bracket 180 such that the pusher member 170 passes through the screw bush 190 and configured to move the pusher member 170 radially when the pusher member 170 rotates.

The bearing bracket 180 may be installed between the rotary shaft 160 and the segment member 120 by a pair of elastic restoration devices 200. The bearing bracket 180 may have a through-hole formed at the center so that the lower end of the rotary shaft 160 and the pusher member 170 pass through the through-hole.

The screw bush 190 may be in the form of a circular disk having a through-hole formed at the center so that the pusher member 170 passes through the through-hole, and may be mounted on the intermediate outer peripheral surface of the pusher member 170.

The lower end of the rotary shaft 160 may be inserted into the upper portion of the pusher member 170. The pusher member 170 may be movable in the axial direction with respect to the rotary shaft 160, but may be connected so as not to rotate with respect to the rotary shaft 160 and can rotate together with the rotary shaft 160. To this end, the rotary shaft 160 may have a plurality of longitudinal grooves formed on the outer peripheral surface of the lower end thereof, and the pusher member 170 may have a plurality of protruding ribs, which are formed on the inner peripheral surface of the upper end thereof and correspond to the grooves of the rotary shaft 160. Thus, the rotary shaft 160 and the pusher member 170 may rotate together, and the pusher member 170 may move in the axial direction with respect to the rotary shaft 160.

The screw bush 190 may include a screw cam 197 formed on the lower surface around the central through-hole, and the pusher member 170 may include a screw rib 179 slidably coupled to the screw cam 197 on the outer peripheral surface. The screw cam 197 may be in the form of a thread having a predetermined pitch corresponding to the screw rib 179. Thus, when the pusher member 170 is rotated together with the rotary shaft 160, the pusher member 170 moves toward the segment member 120 by the screw bush 190, and the segment member 120 and the several ring segments 110 coupled thereto may be moved radially inward.

Meanwhile, the apparatus according to the exemplary embodiment may further include a pair of elastic restoration devices 200 which are mounted between both sides of the bearing bracket 180 and the ring segments 110 and restore the force during contraction to pull the ring segments 110 radially outward to maintain the gap above a predetermined value.

As illustrated in FIG. 7, each of the elastic restoration devices 200 may include a mounting shaft 202 having one end coupled to an associated one of the ring segments 110 and the other end coupled to the bearing bracket 180, a spring mounting member 206 fixed to the bearing bracket 180 by a coupling member 204 and having a through-hole through which the mounting shaft 202 passes, and a spring 208 having one end coupled to the ring segment 110 and the other end coupled to the spring mounting member 206, the spring 208 being disposed around the mounting shaft 202.

The bearing bracket 180 may include a hub having a through-hole through which the rotary shaft 160 and the pusher member 170 pass, and an airfoil having a plurality of through-holes into which a plurality of mounting shafts 202 are inserted for mounting to the airfoil, and may have a circular disk shape as a whole. The hub may be formed thicker than the airfoil.

The plurality of mounting shafts 202 may consist of two mounting shafts each having one end fastened and coupled to the ring segment 110 by the thread and the other end inserted into and coupled to the bearing bracket 180. The plurality of mounting shafts 202 may support the springs 208 mounted around them so as not to be separated. A pair of mounting shafts 202 may be installed in parallel with the rotary shaft 160 and the pusher member 170.

The spring mounting member 206 may have a circular disk shape smaller than the bearing bracket 180, and may be fastened and fixed to the lower end of the coupling member 204 which is inserted into and coupled to the through-hole formed on the outer side of the bearing bracket 180. The spring mounting member 206 may have a through-hole formed at the center thereof so that the mounting shaft 202 passes through the through-hole, and may have a coupling groove formed around the through-hole so that the upper end of the spring 208 is coupled to the coupling groove.

The spring 208 may be disposed around the mounting shaft 202, and have one end coupled to a coupling groove formed in the ring segment 110 and the other end coupled to the coupling groove of the spring mounting member 206. The spring 208 exerts a restoring force in a direction of contraction in a state in which the actuator ring 130 and the rotary shaft 160 do not rotate, thereby pulling the segment member 120 and several associated ring segments 110 to maintain the tip clearance above a predetermined value.

Figure 8:
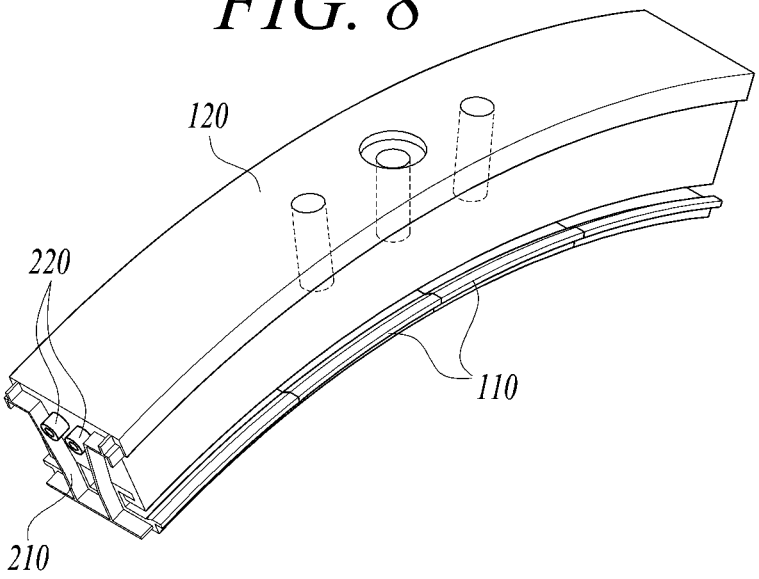
FIG. 8 is a perspective view illustrating a state in which a plurality of ring segments are coupled to one segment member.
Figure 9:
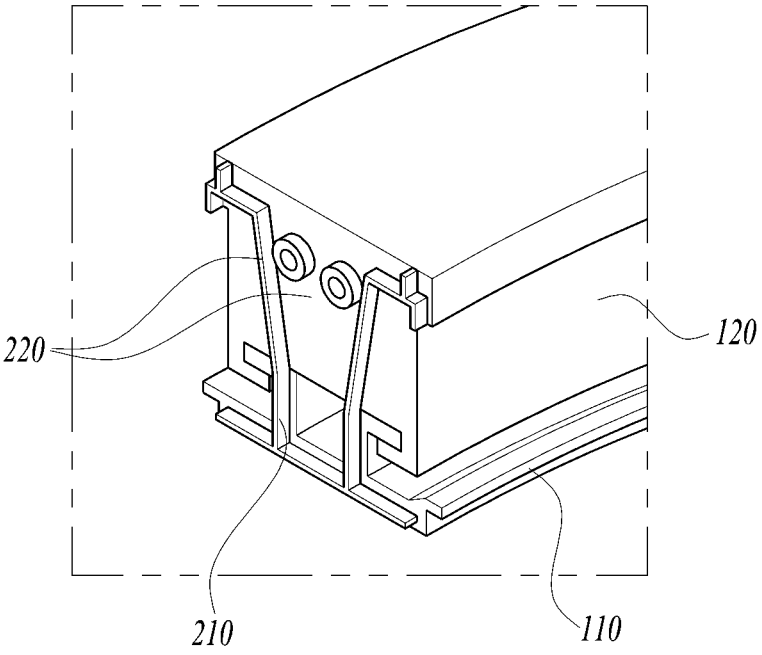
FIG. 9 is an enlarged perspective view illustrating a left side of FIG. 8.
Figure 10:
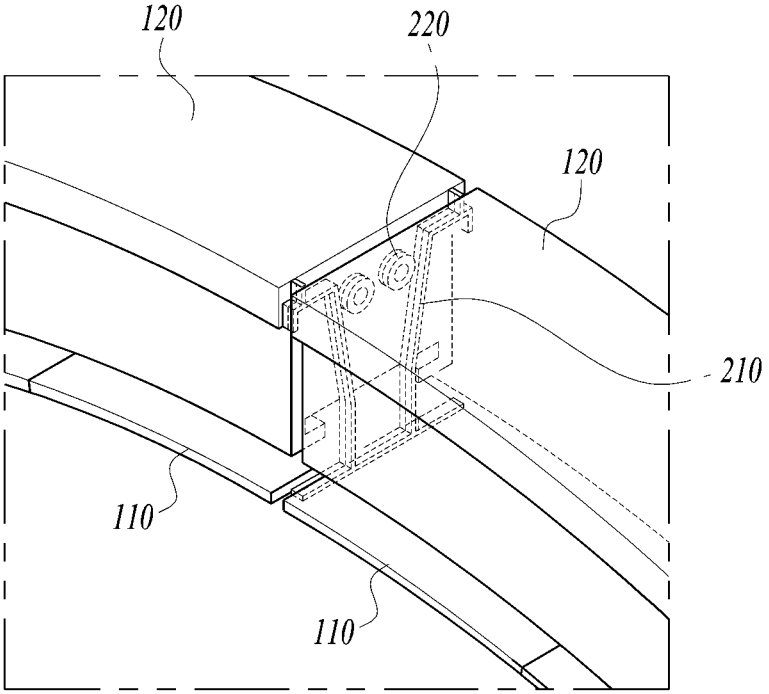
FIG. 10 is a perspective view illustrating a contact portion between two segment members.

FIG. 8 is a perspective view illustrating a state in which a plurality of ring segments are coupled to one segment member. FIG. 9 is an enlarged perspective view illustrating a left side of FIG. 8. FIG. 10 is a perspective view illustrating a contact portion between two segment members.

For example, the plurality of ring segments 110 may be configured such that four to six ring segments 110 are mounted on each of eight segment members 120 arranged circumferentially. The pusher member 170 may be coupled to each of the segment members 120. Referring to FIG. 8, each of the segment members 120 may have a hole formed on the outer peripheral surface thereof so that the end of the pusher member 170 is inserted into the hole so as to be moved in the radial direction, and may have a pair of fastening holes formed on the outer peripheral surface thereof so that the mounting shafts 202 of the pair of elastic restoration devices 200 are coupled to the fastening holes.

The exemplary embodiment in FIGS. 6 and 7 illustrates that four ring segments 110 are mounted on each segment member 120, and the exemplary embodiment in FIG. 8 illustrates that six ring segments 110 are mounted on each segment member 120. If eight segment members 120 are disposed circumferentially, the segment members 120 are arranged at intervals of 45 degrees on the circumference of 360 degree. When the eight segment members 120 are arranged described above, the components related thereto, such as the link member 150, the rotary shaft 160, the pusher member 170, and the pair of elastic restoration devices 200 will each be eight in number.

Referring to FIGS. 8 to 10, the apparatus may further include a seal plate 210 mounted between the circumferential sides of two adjacent segment members 120 of the plurality (e.g., eight) of segment members 120 to prevent leakage of gas therebetween, and a positioning pin 220 mounted across the circumferential sides of the two segment members 120 to allow the two segment members 120 to move radially at the same time.

The seal plate 210 may be mounted between the sides of the two segment members 120 and between the sides of related two ring segments 110. As a result, it is possible to prevent the combustion gas from leaking into the gap between the two ring segments 110, for example, when the tip gap increases. The seal plate 210 may be made of stainless steel material that can withstand high temperatures, and may be subjected to surface treatments to reduce wear and friction.

The seal plate 210 may include an elongated horizontal portion extending in the axial direction of the turbine and disposed on the sides of the ring segments 110 and vertical portions extending radially outward from the horizontal portion and disposed on the sides of the segment members 120. At least two segment members 120 may have grooves formed on the sides thereof so that the vertical portions of the seal plate 210 are inserted and mounted into the grooves. The at least two ring segments 110 may have grooves formed on the sides thereof so that the horizontal portion of the seal plate 210 is inserted and mounted into the grooves.

The seal plate 210 may be assembled in such a way that one circumferential side thereof is fixed to one of the segment members 120 and the other side thereof is inserted into the other segment member 120 with very small tolerances. The width and thickness of the seal plate 210 may be selected in consideration of thermal expansion or the like.

The positioning pin 220 may include two positioning pins inserted and mounted in two insertion grooves formed between the vertical portions of the seal plate 210 on each side of the two segment members 120. Each of the positioning pins 220 may be assembled such that one side thereof is inserted and fixed into the insertion groove of one of the segment members 120 in an interference-fit manner and the other side thereof is inserted into the insertion groove of the other segment member 120 with very small tolerances. The two positioning pins 220 may be mounted on both sides thereof across the sides of the two segment members 120, thereby allowing the two segment members 120 to move uniformly in the radial direction at the same time.

According to one or more exemplary embodiments, it is possible to increase the efficiency of the gas turbine when the gas turbine is operated, by setting the tip clearance large with the elastic restoration devices in a transient section, and by uniformly and optimally reducing the tip clearances of the plurality of turbine blades with the actuator in a normal state.

As described above, according to the apparatus for controlling turbine blade tip clearance and the gas turbine including the same, it is possible to uniformly control the tip clearances of the plurality of turbine blades by rotating the actuator ring installed outside the turbine casing to move the plurality of ring segments arranged in the circumferential direction inside the turbine casing at once.

While one or more exemplary embodiments have been described with reference to the accompanying drawings, it will be apparent to those skilled in the art that various variations and modifications in form and details may be made by adding, changing, or removing components without departing from the spirit and scope of the disclosure as defined in the appended claims, and these variations and modifications fall within the spirit and scope of the disclosure as defined in the appended claims. Accordingly, the description of the exemplary embodiments should be construed in a descriptive sense only and not to limit the scope of the claims, and many alternatives, modifications, and variations will be apparent to those skilled in the art.

What is claimed is:

1. An apparatus for controlling turbine blade tip clearance comprising:

a turbine casing configured to guide a flow of combustion gas;

an actuator ring rotatably mounted outside the turbine casing;

a plurality of turbine blades rotatably mounted inside the turbine casing;

a plurality of ring segments surrounding tips of the turbine blades and installed to form a predetermined gap with each tip;

a plurality of rotary shafts each configured to have one end connected to several of the plurality of ring segments and the other end extending radially from the turbine casing;

a link member configured to rotate an associated one of the rotary shafts according to circumferential rotational motion of the actuator ring;

a pusher member provided at an inner end of the rotary shaft to move the several ring segments radially inward by rotation of the rotary shaft;

a bearing bracket mounted outside the plurality of ring segments and installed such that the pusher member passes through the bearing bracket; and a screw bush mounted in a center of the bearing bracket such that the pusher member passes through the screw bush and configured to move the pusher member radially when the pusher member rotates, wherein the actuator ring rotates back and forth in a predetermined angular range by an actuator installed outside the turbine casing.

2. The apparatus according to claim 1, wherein the link member is connected between the actuator ring and an outer end of the rotary shaft to be eccentric in the rotary shaft and the actuator ring.

3. The apparatus according to claim 2, further comprising an eccentric member coupled to the outer end of the rotary shaft to rotate together with the rotary shaft, the eccentric member extending in a direction perpendicular to the rotary shaft so that the link member is rotatably connected to an end of the eccentric member.

4. The apparatus according to claim 1, wherein a lower end of the rotary shaft is inserted into an upper portion of the pusher member, and the pusher member moves axially with respect to the rotary shaft and rotates together with the rotary shaft so as not to rotate about the rotary shaft.

5. The apparatus according to claim 4, wherein:

the screw bush comprises a screw cam formed on a lower surface around a central through-hole thereof; and the pusher member comprises a screw rib slidably coupled to the screw cam on an outer peripheral surface thereof.

6. The apparatus according to claim 1, further comprising a pair of elastic restoration devices mounted between both sides of the bearing bracket and the ring segments and configured to restore force during contraction to pull the ring segments radially outward to maintain the gap above a predetermined value.

7. The apparatus according to claim 6, wherein each of the elastic restoration devices comprises a mounting shaft having one end coupled to an associated one of the ring segments and the other end coupled to the bearing bracket, a spring mounting member fixed to the bearing bracket by a coupling member and having a through-hole through which the mounting shaft passes, and a spring having one end coupled to the ring segment and the other end coupled to the spring mounting member, the spring being disposed around the mounting shaft.

8. The apparatus according to claim 1, further comprising a plurality of roller bearings mounted on an outer peripheral surface of the turbine casing to support an inner peripheral surface of the actuator ring.

9. The apparatus according to claim 1, wherein:

the plurality of ring segments are configured such that four to six ring segments are mounted on each of eight segment members arranged circumferentially;

the pusher member is coupled to each of the segment members; and the apparatus further comprises a seal plate mounted between circumferential sides of two adjacent segment members of the eight segment members to prevent leakage of gas therebetween, and a positioning pin mounted across the circumferential sides of the two segment members to allow the two segment members to move radially at the same time.

10. A gas turbine comprising:

a compressor configured to compress outside air;

a combustor configured to mix fuel with the air compressed by the compressor to bum a mixture thereof;

a turbine comprising a plurality of turbine blades in a turbine casing rotated by combustion gas discharged from the combustor to generate power; and an apparatus for controlling tip clearance between the turbine casing and the turbine blades, wherein the apparatus for controlling tip clearance comprises:

the turbine casing configured to guide a flow of combustion gas;

an actuator ring rotatably mounted outside the turbine casing;

the plurality of turbine blades rotatably mounted inside the turbine casing;

a plurality of ring segments surrounding tips of the turbine blades and installed to form a predetermined gap with each tip;

a plurality of rotary shafts each configured to have one end connected to several of the plurality of ring segments and the other end extending radially from the turbine casing;

a link member configured to rotate an associated one of the rotary shafts according to circumferential rotational motion of the actuator ring;

a pusher member provided at an inner end of the rotary shaft to move the several ring segments radially inward by rotation of the rotary shaft;

a bearing bracket mounted outside the plurality of ring segments and installed such that the pusher member passes through the bearing bracket; and a screw bush mounted in a center of the bearing bracket such that the pusher member passes through the screw bush and configured to move the pusher member radially when the pusher member rotates, wherein the actuator ring rotates back and forth in a predetermined angular range by an actuator installed outside the turbine casing.

11. The gas turbine according to claim 10, wherein the link member is connected between the actuator ring and an outer end of the rotary shaft to be eccentric in the rotary shaft and the actuator ring.

12. The gas turbine according to claim 11, further comprising an eccentric member coupled to the outer end of the rotary shaft to rotate together with the rotary shaft, the eccentric member extending in a direction perpendicular to the rotary shaft so that the link member is rotatably connected to an end of the eccentric member.

13. The gas turbine according to claim 10, wherein a lower end of the rotary shaft is inserted into an upper portion of the pusher member, and the pusher member moves axially with respect to the rotary shaft and rotates together with the rotary shaft so as not to rotate about the rotary shaft.

14. The gas turbine according to claim 13, wherein:

the screw bush comprises a screw cam formed on a lower surface around a central through-hole thereof; and the pusher member comprises a screw rib slidably coupled to the screw cam on an outer peripheral surface thereof.

15. The gas turbine according to claim 10, further comprising a pair of elastic restoration devices mounted between both sides of the bearing bracket and the ring segments and configured to restore force during contraction to pull the ring segments radially outward to maintain the gap above a predetermined value.

16. The gas turbine according to claim 15, wherein each of the elastic restoration devices comprises a mounting shaft having one end coupled to an associated one of the ring segments and the other end coupled to the bearing bracket, a spring mounting member fixed to the bearing bracket by a coupling member and having a through-hole through which the mounting shaft passes, and a spring having one end coupled to the ring segment and the other end coupled to the spring mounting member, the spring being disposed around the mounting shaft.

17. The gas turbine according to claim 10, further comprising a plurality of roller bearings mounted on an outer peripheral surface of the turbine casing to support an inner peripheral surface of the actuator ring.

18. The gas turbine according to claim 10, wherein:

the plurality of ring segments are configured such that four to six ring segments are mounted on each of eight segment members arranged circumferentially;

the pusher member is coupled to each of the segment members; and the apparatus further comprises a seal plate mounted between circumferential sides of two adjacent segment members of the eight segment members to prevent leakage of gas therebetween, and a positioning pin mounted across the circumferential sides of the two segment members to allow the two segment members to move radially at the same time.

* * * * *